United States Patent [19]

Alsip

[11] Patent Number: 4,875,687

[45] Date of Patent: Oct. 24, 1989

[54] THREE DIMENSIONAL GAME

[75] Inventor: Bruce F. Alsip, Bainbridge Island, Wash.

[73] Assignee: Alsip & Company, Bainbridge Island, Wash.

[21] Appl. No.: 265,256

[22] Filed: Oct. 31, 1988

Related U.S. Application Data

[63] Continuation of Ser. No. 183,887, Apr. 20, 1988.

[51] Int. Cl.[4] ..... A63F 3/00; A63F 3/06

[52] U.S. Cl. ..... 273/241; 273/271

[58] Field of Search ..... 273/271, 241, 153 S, 273/287, 273

[56] References Cited

U.S. PATENT DOCUMENTS 1,655,296 1/1928 Tapio ..... 273/144 A 3,021,140 2/1962 Lushansky ..... 273/271

FOREIGN PATENT DOCUMENTS

WO82/03793 6/1982 PCT Int'l Appl. ..... 273/153 S

*Primary Examiner*—Edward M. Coven

*Assistant Examiner*—Benjamin Layno

*Attorney, Agent, or Firm*—Graybeal, Jensen & Puntigam

[57] ABSTRACT

A three dimensional game including a base element (10) including a plurality of bores (20, 22, 24) each rotatably containing a cylindrical member (32, 23, 36). Each cylinder has a plurality of radial shallow bores (40) for receiving game pieces (26) which are selectively placed in one of the bores (40) by passing through one of the openings (26, 28, 30) in the top of the bore element (10).

3 Claims, 1 Drawing Sheet

THREE DIMENSIONAL GAME

This is a continuation of Ser. No. 183,887 filed Apr. 20, 1988.

BACKGROUND OF THE INVENTION

Games of chance are extremely popular both for entertainment and for improving skills. One of the games that has been popular for many many years is tic tac toe and impriovements on the game have been made including a three dimensional board and/or other variations. The current invention is in reality fairly traditional in the fact that it is scored on a single plane, however the playing pieces may be hidden from view during the time of an individual players turn.

TECHNICAL FIELD

This invention relates to a three dimensional game and more particularly to a tic tac toe game wherein playing pieces are individually placed within a pocket in a horizontal cylinder and then the cylinder is rotated about its axis so that the next player must attempt to complete the game out of memory.

DESCRIPTION OF THE PRIOR ART

Prior art references dealing with similar games include U.S. Pat. No. 2,628,838 granted to Smalley on Feb. 17, 1953 which discloses a tic tac toe game wherein a plurality of rotatable blocks are captured within a board by placing a particular face up either the naughts or the crosses are exposed.

U.S. Pat. No. 2,949,306 granted to Gitelson et al. on Aug. 16, 1960 discloses a plurality overlapping tic tac toe boards arranged in a folding interchangeable relation.

U.S. Pat. No. 3,410,011 granted to Bowman on Nov. 12, 1958 discloses a plurality of rotatable playing pieces having selectively disclosable faces.

U.S. Pat. No. 3,588,113 granted to Nelson on June 28, 1971 discloses a tic tac toe type game wherein the player can, in addition to placing his playing piece, rotate the board to make it more difficult for his opponent to win.

U.S. Pat. No. 4,440,395 granted to Hyland et al. on Apr. 3, 1984 discloses a variable geometric board of the rubik cube variety.

U.S. Pat. No. 3,674,272 granted to Wszalek on July 4, 1972 discloses a game based upon tic tac toe wherein the playing pieces are magnetic and opposing players placed upon opposite sides of a vertical playing board and are not aware of previous moves by their opponent.

SUMMARY OF THE INVENTION

With the above noted prior art in mind it is an object of the present invention to provide a novel game of skill wherein the playing rules are simple, enabling it to be of interest to a wide variety of ages of players, and yet sufficiently complex to keep the interest of the more sophisticated player.

It is another object of the present invention to provide a game device which includes a base member having a plurality of horizontal bores intersected by vertical bores and wherein a cylinder having radially disposed pockets is placed within a horizontal bore to receive game pieces placed through the vertical bore during play.

It is still another object of the present invention to provide a game, including an appropriate device, wherein a tic tac toe type game may be played where each individual player must recall the previous plays in order to move the game forward.

BEST MODE FOR CARRYING OUT THE INVENTION

Figure 1:
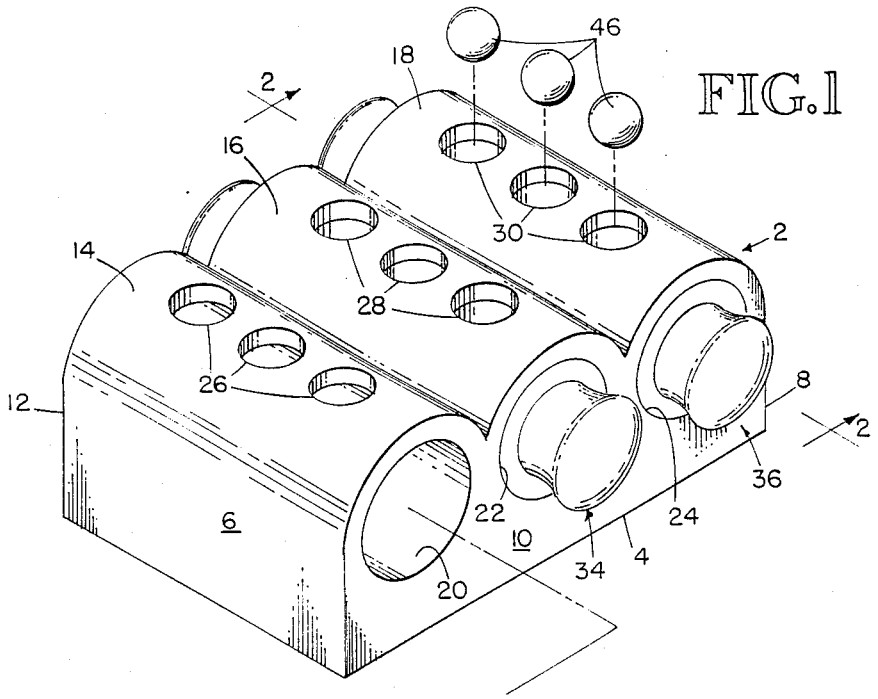
FIG. 1 is a partially exploded isometric view of the inventive game.

As seen in FIG. 1 the present invention includes a game device including a main base element 2 having a flat bottom surface, vertical sides 6, 8, and a vertical front 10, and back 12. The top of the main game board is formed by three parallel arcuate surfaces 14, 16, 18 which extend the full width and each of which extend the full length of the body. Beneath the arcuate surfaces 14, 16, 18 are parallel bores 20, 22, 24 extending the full depth of the game member. Each one of the bores 20, 22, 24 is broken by vertical bores 26, 28, 30 which extend radially of the horizontal bores 20, 22, 24 and intersect with same.

Rotatably received within the bores 20, 22, 24 are cylindrical members 32, 34, 36 respectively, each of which cylindrical members includes a cylindrical main body portion 38 having a plurality of shallow bores or pockets 40 located in rows or sets to correspond with vertical bores in the main body portion and having another identical set located at 120° around the exterior of the cylinder. It is to be noted that the bores do not extend totally through the cylinders and serve as a pocket to receive the playing pieces as explained hereinafter. For convenience in rotating the cylinders within the horizontal bores a handle member 42, 44 is provided at each end of the cylindrical members.

Figure 2:
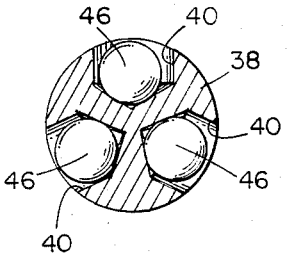
FIG. 2 is a vertical section along lines 2—2 of FIG. 1.
Figure 2:
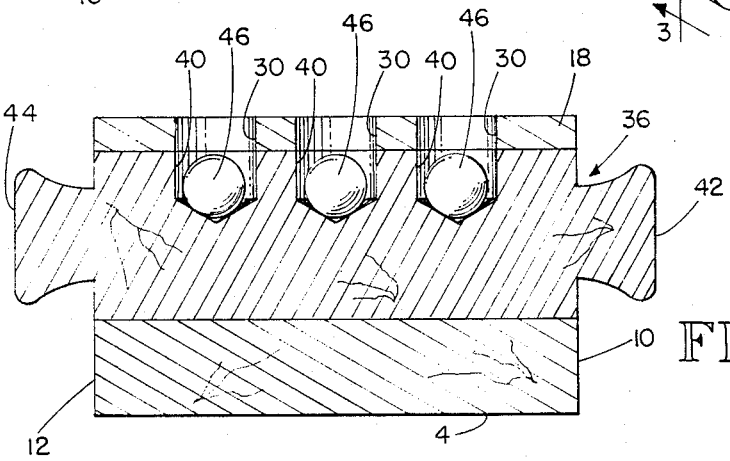

Reference is now had to FIG. 2 which, as noted hereinabove is a section line along lines 2—2 of FIG. 1 and discloses a cylinder member, in this case 36, in place within the main body portion and shows the bores 40 of the cylinder in line with the bores 30 of the main body portion such that the playing pieces 46 can be placed in the pocket to move the game forward.

Figure 3:
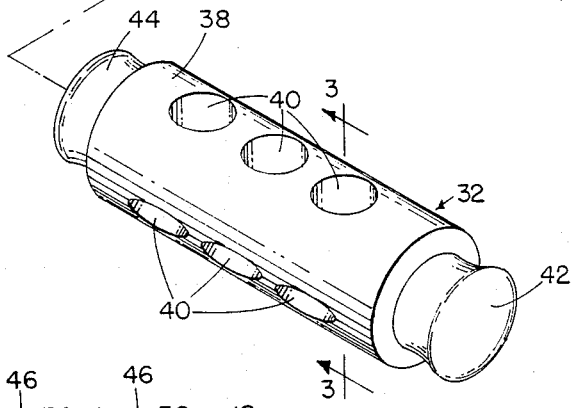
FIG. 3 is a vertical section along lines 3—3 of FIG. 1.

Reference is now had to FIG. 3 which is a vertical view through the cylinder 38 and clearly illustrates that the bores are located at 120° from each other around the cylinder.

In operation players will alternately place a distinctive playing piece in one of the pockets in one of the cylinders, rotate the cylinder so that the playing piece is no longer visible and each player will sequentially take their turn until a score of three identical playing pieces in a line is reached.

Thus it can be seen that the present invention contemplates a novel game including both strategy and skill and includes a novel game piece including a main body portion and three horizontal cylinders.

I claim:

1. A game of skill comprising:

a main body portion including a plurality of parallel elongated primary openings therein, each primary opening having a plurality of parallel secondary openings intersecting therewith said secondary openings extending to a common surface of the main body portion, a plurality of elongated operating elements, one located in eachprimary opening, said operating elements rotatable about their axis within the primary opening and including a plurality of indicia receiving locations, said indicia receiving locations being spaced both axially and circumferentially for selective alignment with the secondary openings whereby indicia may be placed on the operating element during a player's turn and the operating element rotated to mask the indicia during subsequent turns whereby a player must rely upon memory to effectively play the game.

2. A game of skill comprising:

a main body portion including an essentially solid block including a plurality of parallel horizontal bores, each of said horizontal bores including a plurality of parallel extending bores extending radially from and intersecting with the horizontal bores and extending to the upper surface at the main body portion, a plurality of solid cylindrical members rotatably received in each of the horizontal bores, each of said cylindrical members including at least one set of radially separated bores capable of being aligned coaxially with the radial bores of the main body portion whereby a playing piece may be placed within a bore of a cylindrical member and the cylindrical member is turned to hide the playing piece.

3. A game of skill as in claim 2 above in the main body portion includes three horizontal bores to receive three solid cylindrical members and each cylindrical member includes three sets of three bores located at 120° from each other.

* * * * *